US008277367B2

(12) United States Patent
Jannin et al.

(10) Patent No.: US 8,277,367 B2
(45) Date of Patent: Oct. 2, 2012

(54) MACHINE FOR SHAPING BLANKS OF CARDBOARD BOXES

(75) Inventors: Michel Jannin, Octeville sur Mer (FR); Pascal Murano, Octeville sur Mer (FR)

(73) Assignee: Sidel Participations, Octeville sur Mer (FR)

( * ) Notice: Subject to any disclaimer, the term of this patent is extended or adjusted under 35 U.S.C. 154(b) by 563 days.

(21) Appl. No.: 12/446,217

(22) PCT Filed: Oct. 19, 2007

(86) PCT No.: PCT/FR2007/001725

§ 371 (c)(1), (2), (4) Date: Jul. 30, 2009

(87) PCT Pub. No.: WO2008/047008

PCT Pub. Date: Apr. 24, 2008

(65) Prior Publication Data

US 2010/0210440 A1 Aug. 19, 2010

(30) Foreign Application Priority Data

Oct. 20, 2006 (FR) ..... 06 09200

(51) Int. Cl.
*B31B 49/00* (2006.01)

(52) U.S. Cl. ..... 493/374; 493/309

(58) Field of Classification Search ..... 493/309, 493/374, 318, 319

See application file for complete search history.

(56) References Cited

U.S. PATENT DOCUMENTS

| | | | | |
|---|---|---|---|---|
| 4,157,058 | A * | 6/1979 | Vogel | 493/124 |
| 5,813,965 | A * | 9/1998 | Mitchell et al. | 493/315 |
| 6,699,165 | B1 * | 3/2004 | Krieger et al. | 493/122 |
| 7,131,941 | B2 * | 11/2006 | Makar et al. | 493/309 |
| 7,316,642 | B2 * | 1/2008 | Martelli | 493/309 |
| 8,075,467 | B2 * | 12/2011 | Monti | 493/309 |

FOREIGN PATENT DOCUMENTS

| | | |
|---|---|---|
| DE | 44 14 018 A1 | 11/1994 |
| DE | 197 00 236 C1 | 7/1998 |
| EP | 0 027 968 A1 | 5/1981 |

* cited by examiner

*Primary Examiner* — Sameh H. Tawfik

(74) *Attorney, Agent, or Firm* — Sughrue Mion, PLLC

(57) ABSTRACT

The machine according to the invention comprises a store containing the blanks; an extractor arm; means for shaping the blanks; and an upstream transport device for receiving and distributing the blanks of the boxes. The extractor arm and the shaping means are provided on the frame of a bench, which is inserted, as in a module, between the store and the upstream transport device. Said bench comprises: a ramp which is upwardly inclined at an angle of 45° in relation to the horizontal and acts as a guiding channel; a sole having an upper part, in the region of the shaping station, which can be retracted to enable the blank to pass via the ramp; a transport system for moving the blanks from the lower point to the upper point; a forming arm carried by a framework which extends above the ramp; and a transfer arm which participates in the shaping of the blank before moving it, once it has become a box blank on the downstream transport device.

8 Claims, 5 Drawing Sheets

4
64
62
24
61'
20
41
30
40
70
39,H
42
34
36
62
61
44
60
21
a
B,63
32
22
43
60
63

MACHINE FOR SHAPING BLANKS OF CARDBOARD BOXES

CROSS REFERENCE TO RELATED APPLICATIONS

This application is a National Stage of International Application No. PCT/FR2007/001725 filed Oct. 19, 2007, the contents of all which are incorporated herein by reference in their entirety.

FIELD OF THE INVENTION

This invention relates to a machine for shaping box blanks using cardboard cutouts and in particular "American box"—type cutouts, with or without flaps.

DESCRIPTION OF THE PRIOR ART

The preparation of a box blank involves a series of operations that are linked together on the shaping machine: —an operation of extracting the cutout that is stored in a storage site, —an operation of erecting the cutout in the form of a box blank, then—an operation of transferring and removing said blank.

The machine therefore comprises a plurality of juxtaposed stations, and in particular: —a storage station, or storage site, of the "fifo" type, where the cardboard cutouts are housed, —a forming station, and—a removal station with, in addition, depending on the case, a filling station that can be combined with the forming station, and a box finishing station or, for special wrappings, one or more stations for operations that consist of adjoining a base and/or a lid.

This type of machine is used in boxing installations, for example, for preparing box blanks that enable diverse and varied products, such as flasks, bottles and the like, to be wrapped and packaged.

In consideration of the wide variety of products to be wrapped, the boxing machines are increasingly versatile, i.e. they are capable of handling cutouts with a wide variety of formats in order to prepare boxes suitable for the products to be packaged.

However, this versatility has a tendency to result in relatively complex and especially bulky machines because they are designed in consideration of the largest format of cutout to be shaped in the form of boxes.

The space available for integrating this type of machine at existing sites is sometimes limited, and this integration can cause, for the operators, working conditions that are not necessarily ideal, in particular with regard to ergonomics.

The operators must indeed be capable of moving around the machine if only to supply it with cardboard cutouts. They must also be capable of moving around the machine to perform adjustments when the cutout formats are changed, or during maintenance, and they must be capable of intervening under good conditions in the event of any incident.

The development of these machines is therefore becoming increasingly complex while the delivery times for these machines are decreasing.

SUMMARY OF THE INVENTION

The invention is intended to overcome the disadvantages of the current machines by proposing an original concept that enables, first, the user requirements to be satisfied more easily, whether concerning time periods, the bulk of the machine, and so on.

It is also intended to improve the general ergonomics of the machine and the working conditions of the operators, and in particular the working conditions of the operator responsible for positioning the cutouts in the storage site.

It also enables the interventions on the machine in order to perform the necessary adjustments when changing formats to be minimized.

The original design of the machine also enables high box blank preparation speeds to be reached, and therefore enables the speed over the entire boxing line to be substantially increased.

The machine for shaping cardboard box blanks according to the invention includes, combined on a single chassis: —a storage station, or storage site, of the "fifo" type, in which the cutouts are deposited, —arm-type means with suction cups for picking up said cutouts one by one in said storage site, —arm-type means also for erecting each cutout, and—a downstream conveyor device for taking over and removing the box blanks, which pick-up and erecting means are combined on the frame of a forming bench that is placed, as a module, between said cutout storage site and said downstream conveyor device, which bench includes:

- a ramp, such as said frame, inclined upward at an angle between 30° and 60°, approximately 45°, with respect to the horizontal, which ramp acts as a guide passage for the cutouts, and it consists of two corners arranged laterally with an adjustable spacing that corresponds to the width of the cutouts, which corners form both the soleplate and the lateral walls for said cutouts, guiding them during the trajectory between the bottom point and the top point of said ramp, in which said ramp is divided into two portions: a lower portion with a soleplate that is stationary and an upper portion, at the level of the forming station, with a soleplate that is retractable so as to enable the passage of the blank across said ramp between the lateral walls in order to be transferred to said removal conveyor device;
- a transverse shaft located at the lower portion of the ramp and the frame, serving as a pivot for the extractor arms, which pick up the cutouts in the storage site, which extractor arms pivot under the effect of suitable actuator-type means;
- a repository of which the reference point is located in the lower portion of said ramp, opposite the edge of the storage site outlet, in order to receive and hold the cutouts brought by said extractor arms;
- a second repository of which the reference point is located at mid-height on said ramp, at the level of the inlet of the forming station, in order to wedge the cutouts before and during the forming thereof;
- an inclined conveying system, which extends over the lower half of the length of said ramp in order to move said cutouts from one repository to the other, given that the distance between the two repositories is substantially greater than the largest cutout format dimension;
- a device for forming each cutout, consisting of at least one forming arm, of the type with suction cups, which is pivotably connected to a transverse shaft and maneuvered by suitable actuator-type means, which transverse shaft coincides, within the cardboard thickness range, with the angle of the dihedral of the upper repository located at the level of said forming station;
- a transfer device, also in the form of an arm with suction cups, pivotably connected to a transverse shaft and maneuvered by suitable means, which transfer arm participates in the forming of the cutout before bringing it, when it has become a box blank, to the downstream conveyor device.

This bench for assembly of the cutout in the form of a box blank enables, due to its inclination, the space between the storage site and the downstream portion of the machine to be reduced, and enables a constant space to be provided regardless of the formats of the cutouts to be processed with said machine.

According to another arrangement of the invention, the ramp of the forming bench comprises, in its lower portion, on its lateral corners, safety stops that are stationary, which stops also act as a repository for the cutout, and they are located on an arc of circle of which the center corresponds to the pivot shaft of the extractor arm, which arc of circle passes through the edge of the storage site outlet.

This structural arrangement enables the ergonomics of the machine to be improved. Indeed, having stationary stops that determine a stationary reference point regardless of the cutout formats enables the storage site to have a soleplate that is also stationary. With a stationary storage site soleplate, the operator performs the loading operations, with cutout packets, always at the same height, for example between 55 and 100 cm, and preferably approximately 85 cm.

Also according to the invention, the system for conveying cutouts on the forming bench consists of an endless belt of which the active side is located in the plane of the soleplate of the ramp of said bench, which belt is centered between the two extractor arms and extends between a lower pulley located upstream of the lower repository and an upper pulley located at the level of the upper repository, upstream of the inlet of the forming station, which belt comprises at least one L-shaped cleat of which the active surface, in the form of a heel, serves as a push member for the cutout, which heel acts as a positioning stop for said cutout at the level of the top reference point, at the inlet of said forming station, and it is located clearly downstream of the anchoring point of said L-shaped cleat on said belt so as to avoid any interference between said conveying system and the box blank when the latter is taken over by the transfer arms in order to be brought to the downstream conveyor device.

According to another arrangement of the invention, the belt of the conveying system comprises two diametrally-opposed cleats that push the cutouts in turns, and said two cleats serve, also in turns, as a positioning stop and a repository for said cutouts, at the level of the forming station.

Also according to the invention, the means for maneuvering the arms that transfer the blanks between the forming station and the downstream conveyor device consist of a servomotor and a connecting rod-crankshaft system inserted between the latter and said arms.

The invention also relates to the process for shaping "American box"—type cutouts by means of the machine described above, which process consists of:

- picking up a cutout in the storage site by means of extractor arms;
- depositing said cutout in the lower repository, which is arranged on the inclined ramp of the forming bench;
- moving said cutout upward in order to bring it to the level of the forming station, in the upper repository;
- erecting said cutout by means of the transfer and forming arms;
- moving the box blank thus formed by means of said transfer arms, between said bench and the downstream conveyor device.

BRIEF DESCRIPTION OF THE DRAWINGS

Also according to the invention, the process for assembling the cutout by means of transfer and forming arms consists of:

- placing the transfer arms in the active position for gripping the lower panel of the cutout;
- placing the forming arm(s) in the active position for taking over the upper adjacent panel of said cutout, in which said cutout is sandwiched between said transfer and forming arms;
- pivoting the forming arm by one-quarter of a circle in order to erect said cutout in the form of a sheath constituting the box blank;
- releasing said upper adjacent panel, i.e. said blank, with respect to said forming arm;
- retracting the upper portion of the soleplate of the ramp, at the level of the forming station;
- bringing said box blank by means of said transfer arms in order to deposit it onto the downstream conveyor device, by crossing said ramp;
- returning said upper portion of the soleplate to the active position in order to continue with a new cycle.

Figure 1:
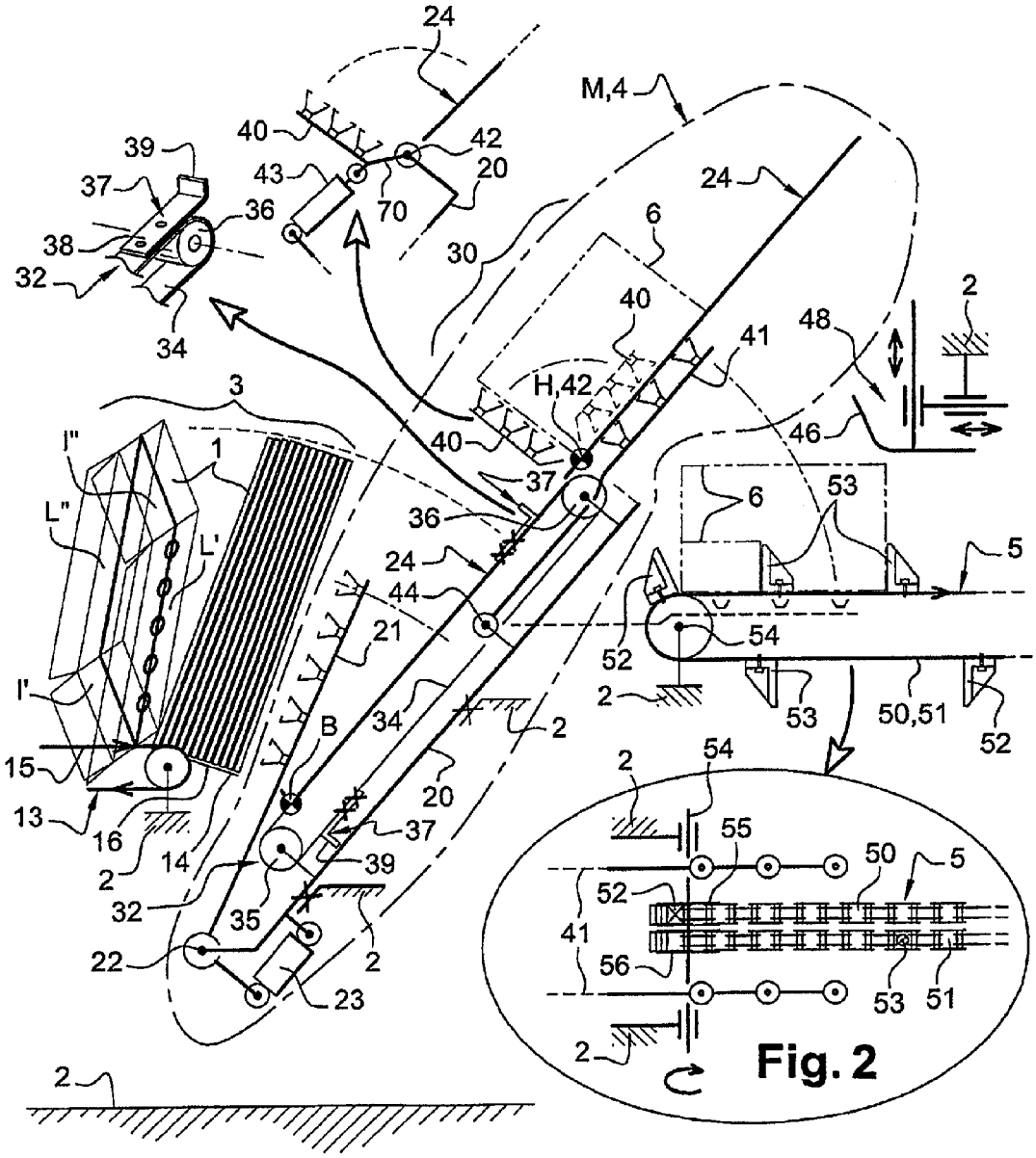
Figures 3, 3A, 3B:
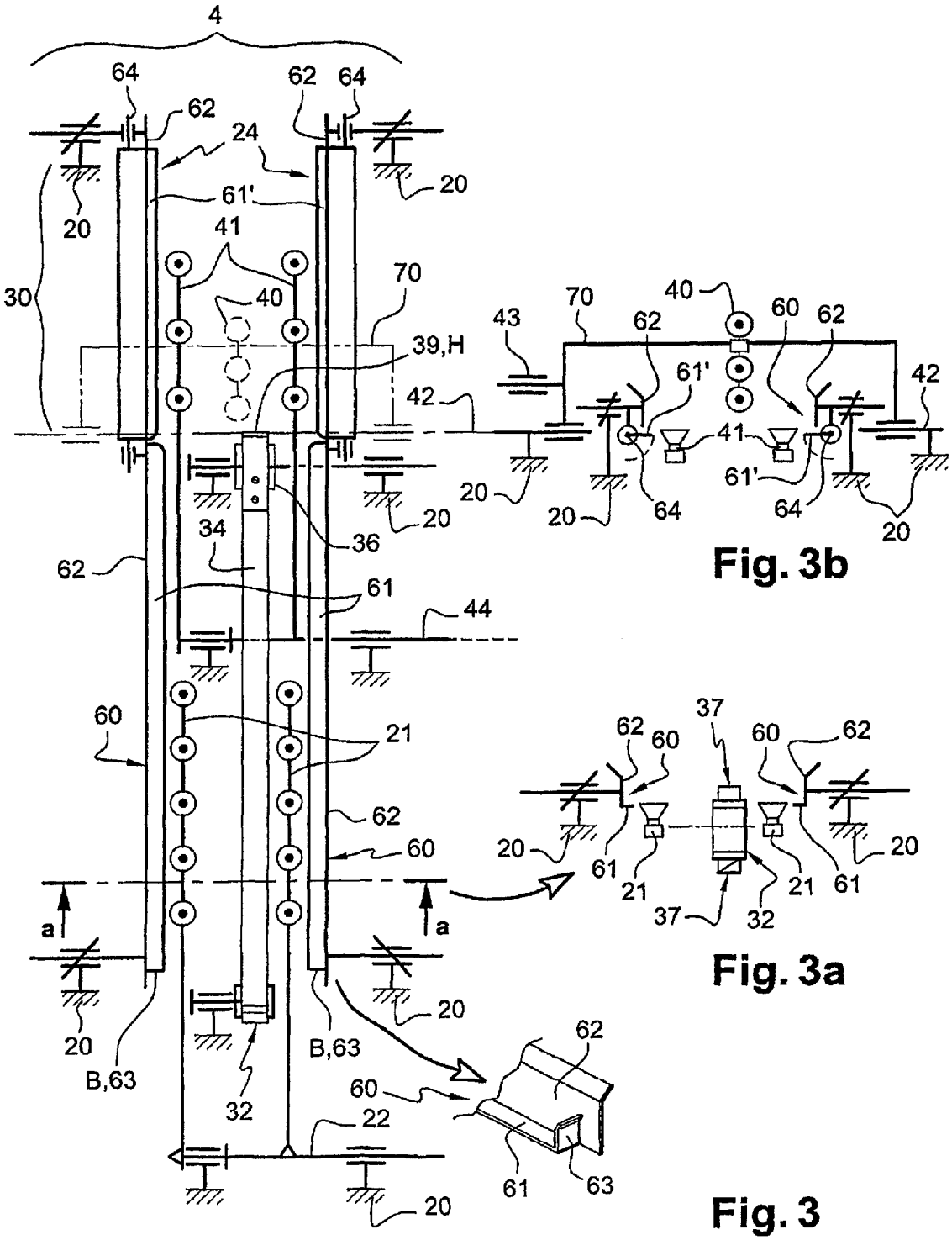

The invention will be further detailed in the following description and appended drawings, provided for indicative purposes, in which:

FIG. 1 shows, in the form of a functional diagram, seen from the side, the elements forming the machine according to the invention;

FIG. 2 is a diagrammatic plan view of the downstream conveyor device also showing the two arms that perform, in particular, the transfer and deposition of the blank on said downstream conveyor device;

FIG. 3 is a diagrammatic plan view of the bench for forming cutouts with, laterally, to the right of the diagrammatic plan, cross-section figures: FIGS. 3*a* and 3*b;*

Figure 4:
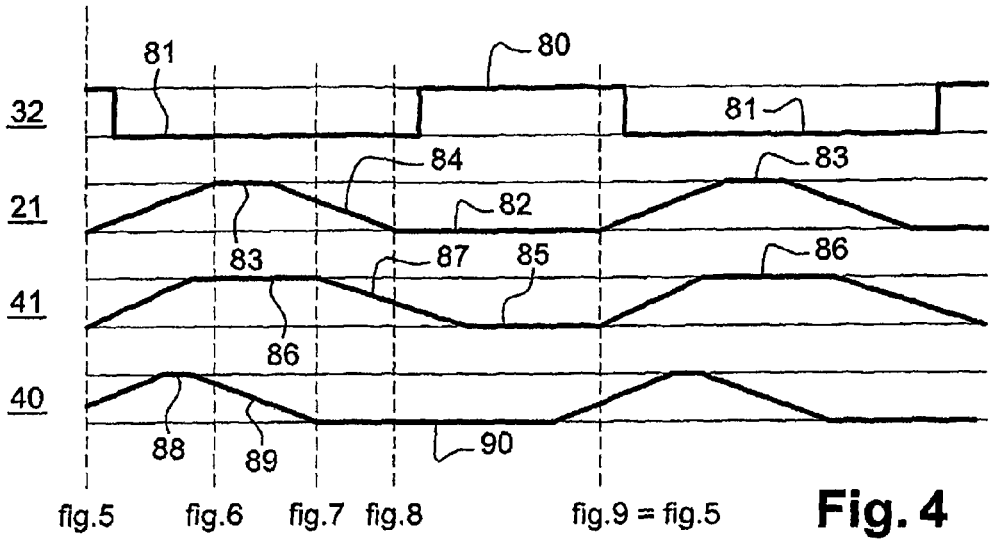

FIG. 4 is a graphic and chronological representation of the movements of the various elements that contribute to the assembly of the cutouts on the forming bench;

FIGS. 5 to 9 show, in relation to FIG. 4, certain steps involved in forming the cutouts, which steps are indicated in the graphic representation of FIG. 4.

DETAILED DESCRIPTION OF THE INVENTION

The machine, diagrammed in FIG. 1, enables "American box"—type cardboard cutouts 1 to be formed.

A cutout 1 is shown at the left of the figure, partially assembled; it comprises sides L' and L", which can be large or small, and sides l' and l", which, conversely, can be small or large. In the figure, the flaps are shown from a single side; the cutout can include them on both sides or be without flaps, in the form of a simple sheath.

These cutouts 1 are prepared in advance and, before being introduced into the machine, they are flat, and delivered in a packet on a pallet, for example.

The forming of these cutouts consists in fact of opening them up in order to create a sheath that constitutes a box blank. The actual box is then made at a so-called pressing station where the flaps are, for example, coated with glue and folded after, depending on the case, an operation of filling the blank with products to be packaged.

This forming machine includes, arranged and assembled on a chassis 2; —a storage site 3 of the "fifo" type for storing cutouts 1, —a module M or bench 4 that comprises all of the elements necessary for the actual forming of said cutouts 1 and—a conveying device 5 arranged downstream in order to take over the box blanks 6 and move them or take them away to other stations or destinations not shown.

The store 3 can comprise, as shown in the figure, a conveyor 13 that moves the cutouts 1 toward the bench 4. The cutouts are inclined toward the outlet; the alignment of their upper edge is downstream of the edge 14 that is arranged at the outlet of the storage site 3.

The upper side of the conveyor 13 acts as a soleplate 15 for the cutouts 1 and this soleplate comprises, beyond the downstream end of said conveyor 13, an extension in the form of a stationary shelf 16 that ends with the edge 14 of the storage site outlet.

The forming of a cutout 1 involves a series of operations that are linked together on the bench 4 by means of a plurality of specific elements detailed below; these different forming elements are all arranged on the same frame 20, which is itself secured to the chassis 2 of the machine. This frame 20 is inclined upward, by an angle of between 30° and 60°, on the order of 45°.

The first operation consists of picking up a cutout 1 in the storage site 3. This operation is performed by means of a pick-up device consisting of two arms 21 called extractor arms; these extractor arms 21 are pivotably connected around a shaft 22 that is located at the lower portion of the frame 20; they are maneuvered by means of an actuator 23, which is anchored on said frame 20.

The cutout 1 is deposited, by the arms 21, in an inclined passage, such as the frame 20, which forms a sort of ramp 24, which will be described in detail below in reference to FIG. 3; this cutout 1 is in fact wedged in a repository provided at the bottom portion of said ramp 24 and in particular at the level of the reference point B.

The next operation consists of bringing the cutout 1 to the forming station 30. This forming is carried out, on said machine according to the invention, at a high point, i.e. at a level that, in a manner unconventional in machines of this type, is located well above the level of the soleplate of the storage site 3, at the level of the downstream conveyor 5.

The movement of the cutout 1, between point B of the lower repository and point H of the upper repository at the level of the forming station 30, is performed by means of a conveying system 32.

Point B is a reference point that is formed by a positioning stop, as described below, in reference to FIG. 3. Point H is a virtual reference point of which the existence is dependent on elements that are associated with the conveying system 32, and of which the placement is carried out according to a cycle associated with the general cutout 1 forming cycle.

This conveying system 32 includes an endless-type belt 34, which extends between pulleys 35, 36, of which one is powered by means of a servomotor, not shown. The pulley 35 is located at the lower portion of the ramp 24, clearly upstream of point B.

This conveying system 32 is also inclined, like the ramp 24 and the frame 20, according to an angle of between 30° and 60°, and preferably approximately 45°.

The cutout 1 is taken over and brought, to the level of point B, by a cleat 37 that is secured to the belt 34. This cleat 37 has a specific L-shape, as shown to the side in FIG. 1. It is noted that the large branch 38 of the cleat 37 is attached to the belt 34 so that the heel 39 of said cleat 37 can advance beyond the downstream end of the conveyor system 32, i.e. beyond the upper pulley 36. In fact, the heel 39 of said cleat 37 serves as a stop for the cutout 1 and it acts as a reference for positioning said cutout 1 at the level of the forming station 30; it establishes the virtual point H of the upper repository.

The belt 34 preferably comprises two cleats 37 that are diametrally opposed and that act, in turns, as repositories.

The pulley 35 of the belt 34 is located at the lower portion of the ramp 24, sufficiently upstream of point B in order to enable the cleat 37, and in particular the heel 39, to be positioned so as to take over the cutout 1 that is waiting, wedged at the level of the reference point B. The pulley 36 is located at mid-height on the ramp 24, upstream of the inlet of the forming station 30, i.e. upstream of point H at the level of which the cutout 1 is wedged by the heel 39 of the cleat 37 when it is in the active position.

This position of the pulley 36, slightly retracted with respect to point H, enables any interference between the latter and the box blank 6 to be avoided during the transfer of said blank 6 to the downstream conveyor device 5.

Point H of the upper repository is located at a distance from point B of the lower repository, which is at least equal to the dimension of the largest cutout 1 format capable of being handled by the machine. This space between the two reference points enables all cutout 1 formats to be handled without having to perform longitudinal adjustments.

The actual forming operation is performed by means of two devices consisting of arms of the type with suction cups: the arm 40 called the forming arm and the arm 41, which, in this case, has a plurality of functions since it also acts as a transfer arm.

The forming arm 40 and the transfer arm 41 are generally, like the extraction arm 21, arranged in pairs in order to secure the operation of taking over and sensing the panels of the cutout 1. In the remainder of the text, the singular or plural will be used indifferently to designate all of these arms since, in certain figures, only one arm can be seen.

The transfer arm 41 is primarily intended in this forming operation to keep the L' side of the cutout 1 in the plane of the repository of station 30. The actual forming is performed by the forming arm 40. This arm 40, as described in detail below, is arranged above the plane of circulation of the cutout 1; its pivot shaft 42 coincides with point H of the repository and it is maneuvered by means of an actuator 43, which is anchored on the frame 20, as shown to the side in FIG. 1.

When it arrives at the station 30, the cutout 1 is sandwiched between the transfer arm 41 and the forming arm 40. The latter pivots around its shaft 42, with an amplitude on the order of a quarter of a circle, bringing side l' of the cutout 1, while the arm 41 remains stationary, holding side L'.

Once the cutout 1 has been formed, the arm 40 is detached from side l' and the arm 41 is moved so as to transfer the blank 6 to the conveyor device 5, which takes it over for other operations.

The transfer arm 41 is pivotably connected to a shaft 44, which is located at the level of the conveyor device 5. It is maneuvered by means of a drive member, of the servomotor type; this servomotor actuates the arm 41 by means, for example, of a connecting rod-crankshaft-type system, not shown, which ensures smooth operation.

One will note a guide 46 above the conveyor device 5. This guide 46 is intended to hold the blank 6 in the shape that it was given at the erecting station 30, first during its transfer to the conveyor device 5, and then when it is moved by the latter.

Figure 8:
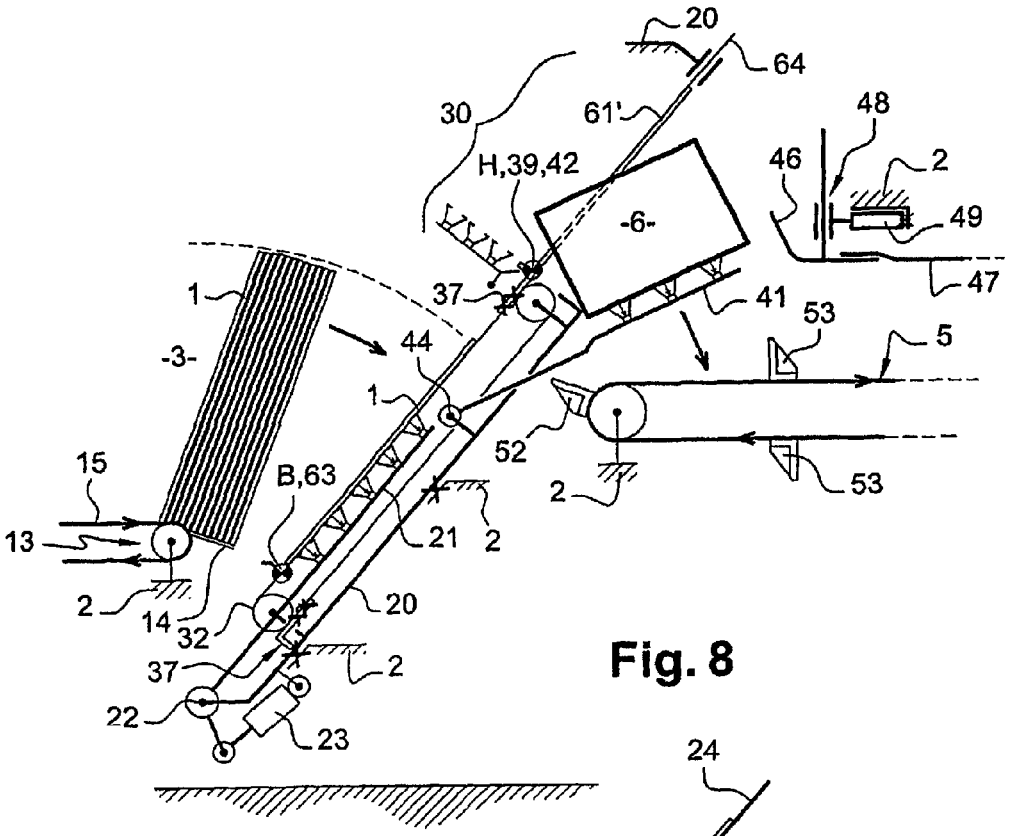
Figure 9:
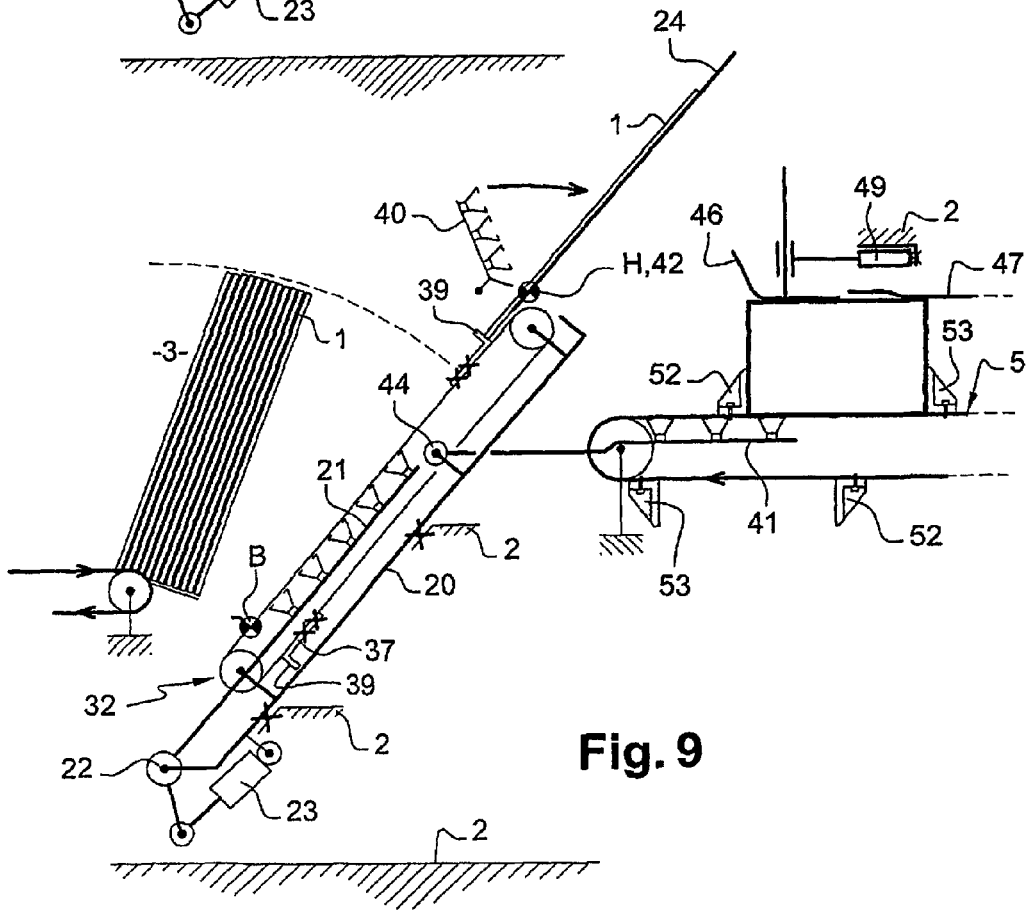

This guide 46 forms the inlet and the opening of an arch 47, which can be seen in FIGS. 8 and 9, which forms, with the conveyor device 5, a guide passage for the blank 6; to enable its adjustment, this guide 46 is secured to the chassis 2 by means of a slide system 48.

This guide 46 is moreover capable of moving longitudinally in the upstream direction, by means of an actuator 49, which is shown in FIGS. 8 and 9, in order to be positioned on the blank 6 when it is placed on the conveyor device 5 and when it is released by the transfer arms 41.

The downstream conveyor device 5 is diagrammatically shown in FIG. 2, from a top view. It consists in particular of two chains 50, 51 of the endless chain type, which are equipped with cleats 52, 54, respectively, for gripping the blank 6. One of the chains, chain 50, comprises upstream cleats 52 that push the blank 6; the other chain, chain 51, comprises cleats 53 that are arranged on the downstream face of said blank 6. The two chains 50, 51 are mounted separately and can be offset from one another in order to adjust the spacing between the cleats 52 and 53 according to the formats of the blanks 6.

In this FIG. 2, one will also note the presence of transfer arms 41, which are arranged on each side of the conveyor device 5; these arms 41 are arranged to pass above the shaft 54, which bears the pulleys 55, 56 driving the chains 50, 51, respectively.

FIG. 3 is a sort of diagrammatic plan view that shows, with the cross-sections of FIGS. 3*a* and 3*b*, the detail of the bench 4 for forming cutouts 1.

All of the elements shown in FIGS. 3, 3*a* and 3*b* are arranged directly or indirectly on the frame 20, which frame 20 is secured to the general chassis 2 of the machine, as specified earlier.

These FIGS. 3, 3*a* and 3*b* show:

- the conveying system 32 that extends over the lower half of the ramp 24, which conveying system 32 moves the cutouts 1 between points B and H of the lower and upper repositories, respectively.
- the extractor arms 21, which are arranged on each side of said conveying system 32,
- the arms 41, which have a dual function: to ensure that the cutout 1 is held during its forming and to ensure its transfer after it has been transformed into a blank 6, to the downstream conveyor device 5,
- the forming arm 40, which is single or double, shown in FIG. 3*b*, in the inactive position and in FIG. 3 with phantom lines, in the active position for taking over side l' of the cutout 1, as explained earlier,
- and, in greater detail than in FIG. 1, the guide passage for the cutout 1, in the form of a ramp 24.

This ramp 24 consists, in particular in FIG. 3*a*, of two corners 60 arranged laterally to form the guide passage of the cutouts 1.

These corners 60 are arranged on each side of the arms 21 and 41 and they form both the soleplate 61 and the lateral walls 62 for guiding the cutouts 1; they are mounted adjustably with respect to the frame 20 in order to adjust to the various formats of the cutouts 1.

The level of the soleplates 61 is the same as that of the upper active side of the belt 34 of the conveying system 32.

In the lower portion of the ramp 24, the corners 60 are arranged to act as a repository and ensure the wedging of each cutout 1, when deposited by the extractor arms 21. This arrangement is shown to the side at the bottom of FIG. 3; it consists of a stop 63 shaped in the form of a fold, at the end of the soleplate 61, on the corner 60, which stop 63 constitutes the reference point B of the lower repository; it enables the cutout 1 to be held in the waiting position, until said cutout 1 is taken over by the cleat 37 of the conveying system 32 in order to be brought to the forming station 30. This arrangement is performed on each side of the ramp 24, at the lower end of the corners 60.

The reference point B is therefore stationary; it is constant and common for the cutouts 1 regardless of their formats. This point B is located on an arc of circle that passes through the edge 14 of the outlet of the storage site 3, which arc of circle is centered on the shaft 22 of the extractor arms 21. This arrangement enables a storage site 3 to be provided, of which the soleplate 15 is at a constant level with respect to the ground, between 55 and 100 cm, and approximately 85 cm, for example.

The ramp 24, which forms the guide passage of the cutouts 1 comprises two portions: —a bottom portion with corners 60 of which the soleplate 61 is stationary and—a top portion with corners 60 of which the soleplate 61 ' is retractable. This top portion is in fact located at the level of the station 30 for forming the cutout 1. Indeed, when the operation for forming the cutout 1 is terminated, it is necessary to open the cutout guide passage in order to transfer the blank 6 to the downstream conveyor device 5 because said blank 6 passes between the walls 62 of said ramp passage 24.

As shown diagrammatically in FIG. 3*b*, the soleplates 61 40 are longitudinally pivotably connected around shafts 64 in order to pivot under the effect of suitable actuator-type means, not shown, and in order to be retracted, thus freeing the passage to enable the transfer of the blank 6, which is moved by means of the arms 41 also shown in the figure.

According to an alternative embodiment, not shown, the soleplates 61 ' can also be retracted like drawers, laterally, in order to free the passage between the walls 62.

This FIG. 3*b* also shows the foaming arm 40. This arm 40 is arranged as a cantilever or, as shown in the figure, it is arranged on a sort of portal frame 70 that passes over the ramp 24 and the guide passage for the cutouts 1. This portal frame 70 is maneuvered by means of the actuator 43, which is shown to the side in FIG. 1, and it pivots around the shaft 42 arranged transversally, which shaft 42 coincides, within the cardboard thickness range, with the point H of the upper repository, i.e. with the angle of the dihedral formed by the soleplate 61 ' and the heel 39 of the cleat 37 when the latter is in the top active position, at the inlet of the forming station 30.

FIG. 4 shows, in the form of a chronological diagram, the movements and positions of the various elements of the bench 4 that are involved in forming the cutouts 1. This diagram is associated with FIGS. 5 to 9, which diagrammatically show some of the phases of the process for forming cutouts 1. In this FIG. 4, the conveying system 32 comprises, over a cycle, a period 80 in which it is in movement and a period 81 in which it is at rest; during this rest period, the heel 39 of the cleat 37, which is in the top position, serves as a reference point H.

The cycle of the extractor arms 21 comprises a rest period 82, which corresponds substantially to the time necessary for moving the cutout 1 between the two reference points B and H, by means of the conveying system 32. The arms 21 pivot in order to go pick up a cutout 1 in the storage site 3, and the period 83 for picking up and extracting the cutout in the storage site 3 is substantially based on the middle of the rest period of the conveying system 32; then, the period 84 of said arms 21 corresponds to the transfer of the cutout 1 in the lower repository, which cutout 1 is wedged at the level of point B, where it will be taken over by the next cleat 37 of said system 32.

The cycle of the transfer arms 41 is practically based on that of the extractor arms 21. It comprises a rest period 85 after the box blank 6 has been deposited on the downstream conveyor device 5, the time for the latter to remove said box blank 6, and a period 86 of taking over the cutout 1 at the level of the forming station 30; at the end of the forming, the arm 41 transfers the box blank to the downstream conveyor device 5, which corresponds to period 87 in the diagram.

The actual forming of the cutout 1 is performed by means of the forming arm 40. The cycle of said arm 40 is similar to that of the other arms; there is first a period 88 of taking over side l' of the cutout 1, then the actual forming period 89, at the end of which the rest period 90, which is relatively long, begins.

Figure 5:
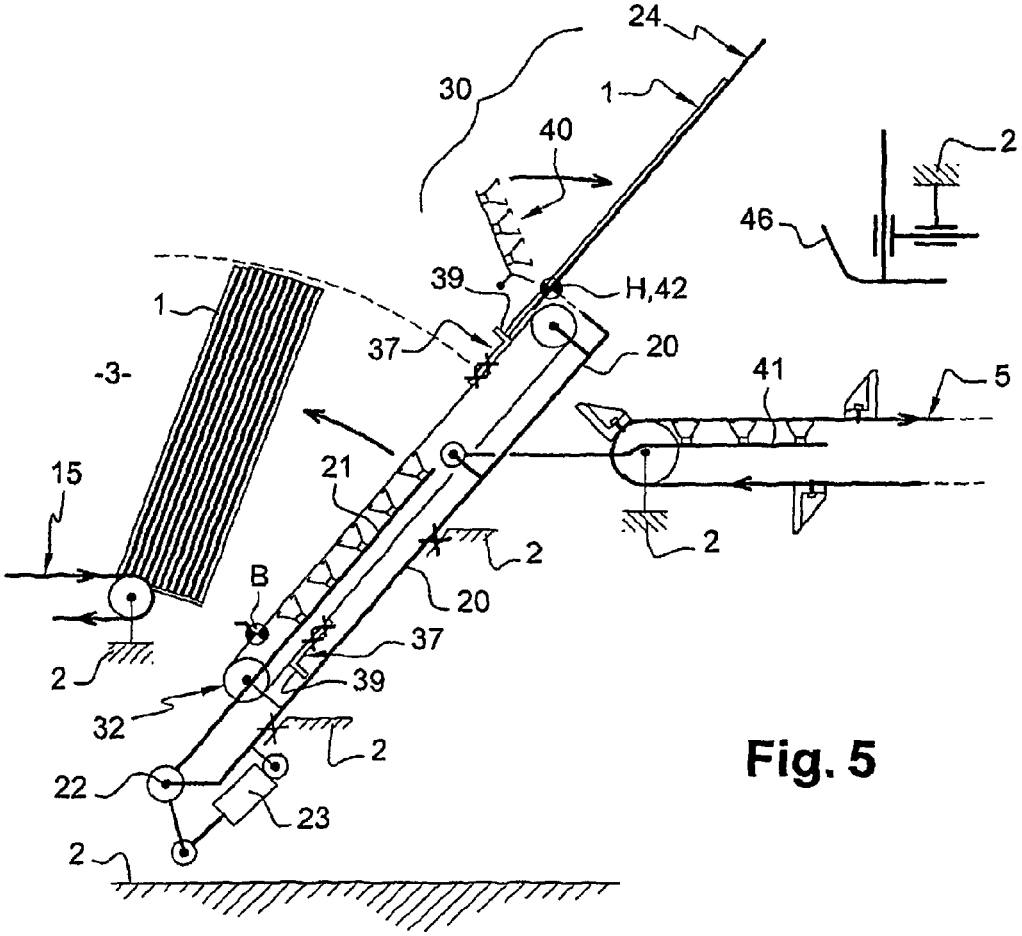

FIG. 5 shows a cutout 1 that is on course between point B of the lower repository and point H of the upper repository, pushed by the heel 39 of the cleat 37 of the conveying system 32. The extractor arms 21 and the transfer arms 41 are at rest, at the end of their rest periods 82 and 84, respectively. The foaming arm 40 begins to pivot in order to take over side l' of the cutout 1, which is arriving at the fanning station 30.

When the cutout 1 is positioned at the forming station 30, wedged at point H of the upper repository, the forming arm 40 presses said cutout 1 on the soleplates 61' and holds this cutout 1 in the repository so as to enable the arms 41 to be positioned.

Figure 6:
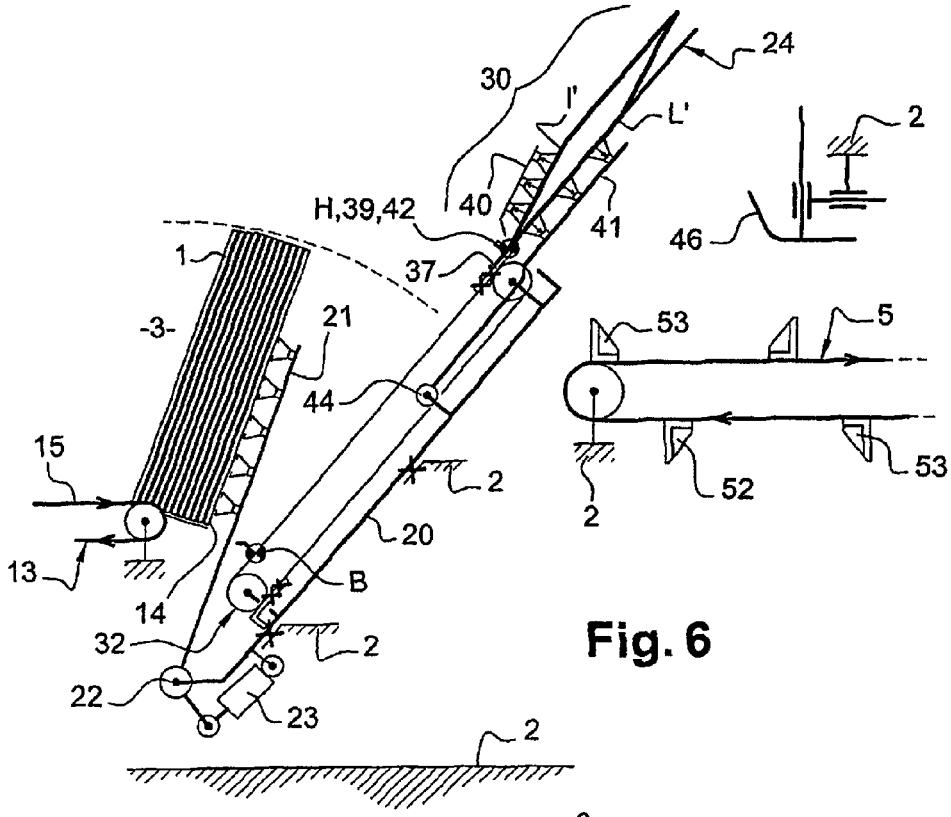

Then, as shown in FIG. 6, the forming arm 40 pivots around its shaft 42, bringing with it side l' of the cutout 1, while the arms 41 hold side L' in the upper repository. It is noted that the shaft 42 of the forming arm 40 coincides with the edge common to sides l' and L' of the cutout 1 and with point H of the upper repository.

Figure 7:
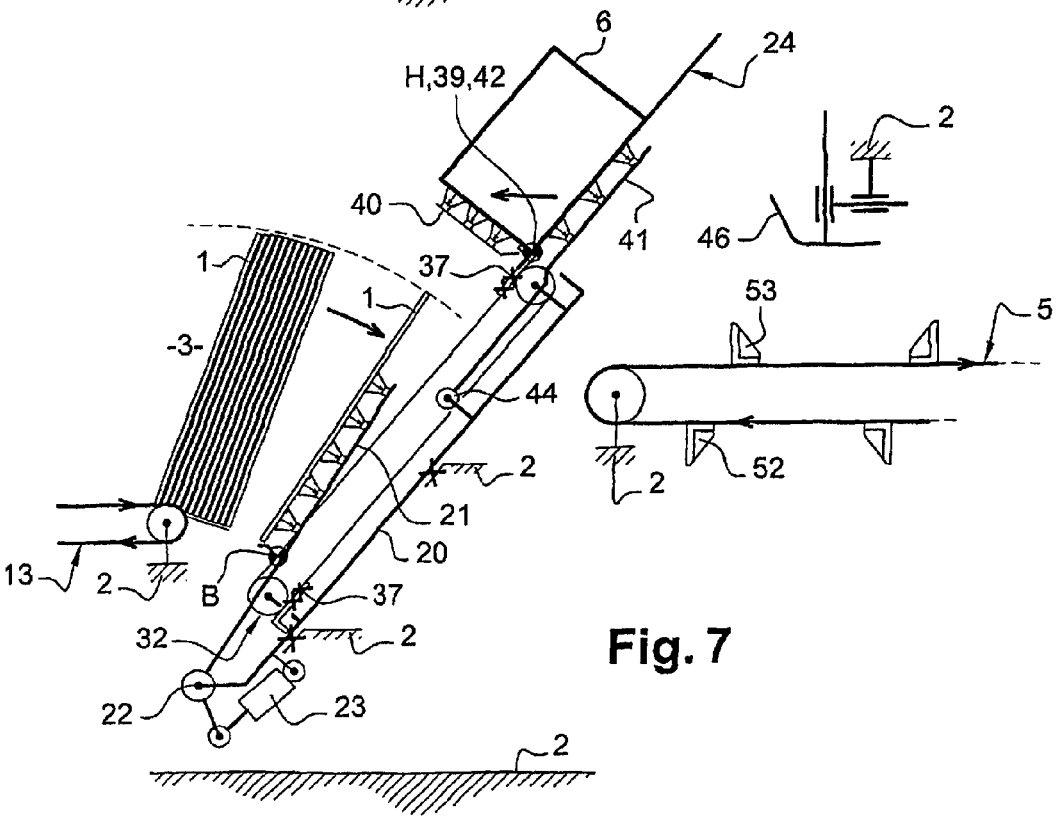

During this operation of assembling the cutout 1 in the form of a box blank 6, as shown in FIGS. 6 and 7, the extractor arms 21 pivot in order to go pick up another cutout 1 at the outlet of the storage site 3, actuated by the maneuvering actuator 23.

When the assembly is complete, as shown in FIG. 7, the forming arm 40 releases side l' by releasing the vacuum in its suction cups while the arms 41 hold side L' in order to be capable of bringing the blank 6 to the downstream conveyor device 5. To be capable of moving the blank 6, the upper portion of the ramp 24 opens, by means of the retraction of the soleplates 61', as shown in FIG. 8, and the transfer arms 41 pivot in order to bring the blank 6 down and deposit it onto the conveyor device 5. During this time, the extractor arms 21 have completed their course and have deposited the new cutout 1 in the lower repository, wedged at the level of point B, waiting to be taken over by the second cleat 37 of the conveying system 32.

During its transfer between the framing station 30 and the conveyor device 5, the blank 6 slides over the guide 46, this prevents it from being deformed. At the end of the course (FIG. 9 ), the blank 6 is deposited on the downstream conveyor device 5 by the transfer arms 41. Before being released by the arms 41, the guide 46 moves in the upstream direction, onto the blank 6, under the effect of its maneuvering actuator 49, in order to hold said blank, which is then brought by the cleats 51, 52 of the conveyor device 5 to the appropriate destination.

Once the passage is freed on the conveyor device 5, the transfer arms 41 return to the forming station 30 in order to hold the new cutout 1, which has just arrived in the upper repository, and the cycle continues.

The invention claimed is:

1. Machine for shaping cardboard box blanks, including, combined on a single chassis:

a storage site, configured for first-in-first-out operation, where cutouts are deposited, arm-type means with suction cups for picking up said cutouts one by one in said storage site, arm-type means also for erecting each cutout, and a downstream conveyor device for taking over and removing box blanks, wherein said pick-up and erecting means are combined on a frame of a bench that is inserted, such as a module, between said storage site and said downstream conveyor device, which bench includes:

a ramp inclined upward at an angle between 30° and 60° , approximately 45° with respect to a horizontal line, which ramp comprises two corners arranged laterally with a spacing that corresponds to a width of the cutouts, which corners form both a soleplate and lateral walls for guiding said cutouts during a trajectory between a bottom point (B) and a top point (H) of said ramp, which ramp is divided into two portions: a lower portion with a soleplate that is stationary and an upper portion, at the level of a forming station, with a soleplate that is retractable so as to enable the passage of the blank across said ramp between the lateral walls in order to be transferred to said downstream conveyor device;

a transverse shaft located at the lower portion of the ramp and said frame, serving as a pivot for extractor arms, which pick up the cutouts in the storage site, which extractor arms pivot under the effect of suitable actuator-type means;

a repository of which the bottom reference point (B) is located at the lower portion of said ramp, opposite the edge of the storage site outlet, in order to receive the cutouts brought by said extractor arms;

a second repository of which the top reference point (H) is located at the upper portion of said ramp, at the level of the inlet of the forming station, in order to wedge the cutouts before and during the forming thereof;

a conveying system, inclined like said ramp, which extends over the lower half of the length of said ramp in order to move said cutouts from one repository to the other, given that the distance between the two repositories (B) and (H) is substantially greater than the largest cutout format dimension;

a device for forming each cutout, comprising a forming arm, comprising suction cups, which is pivotably connected to a transverse shaft and maneuvered by suitable actuator-type means, which transverse shaft coincides, within a cardboard thickness range, with an angle formed by a dihedral of the upper repository located at the level of said forming station;

a transfer device, also in the form of an arm, pivotably connected to a transverse shaft and maneuvered by suitable means, which transfer arms, of the type with suction cups, participate in the forming of the cutout before bringing it, when it has become a box blank, to the downstream conveyor device.

2. Machine for shaping cardboard box blanks according to claim 1, wherein the ramp of the forming bench comprises, at its lower portion, stops that act as reference points (B) for the cutout, which stops are located on an arc of circle of which the center corresponds to the pivot shaft of the extractor arms, which arc of circle passes through an edge of the storage site outlet.

3. Machine for shaping cardboard box blanks according to claim 2, wherein the storage site comprises a soleplate that is stationary with respect to the chassis, which soleplate is arranged at a height, with respect to the ground, of between 50 and 100 cm, preferably approximately 85 cm.

4. Machine for shaping cardboard box blanks according to claim 1, wherein the conveying system comprises an endless belt of which an active side is located in the plane of the soleplate of the ramp of the bench, which belt is arranged between the extractor arms and extends between a lower pulley located upstream of the lower repository and an upper pulley located upstream of the inlet of the forming station, which belt comprises at least one L-shaped cleat and its active surface, forming a heel, which is in contact with the cutout, is located clearly downstream of an anchoring point of said heel on said belt, which heel acts as a reference point (H) for the inlet of said forming station, in an area that is located downstream of said conveying system so as to avoid any interference between said conveying system and the box blank when said blank is taken over by the transfer arms and brought to the downstream conveyor device.

5. Machine for shaping cardboard box blanks according to claim 4, wherein the belt of the conveying system comprises two diametrally-opposed cleats that push the cutouts in turns, each cleat forming a heel, and the heels of said two cleats serve, also in turns, as positioning stops and reference points (H) at the level of the inlet of the forming station.

6. Machine for shaping cardboard box blanks according to claim 1, wherein means for maneuvering the arms that transfer the blanks between the forming station and the downstream conveyor device comprises a servomotor and a connecting rod-crankshaft system inserted between the two.

7. A machine for shaping cardboard box blanks, comprising on a single chassis:

a storage site where cutouts are deposited, the storage site configured for first-in-first-out operation;

a first moveable arm with suction cups configured to pick up the cutouts one by one from the storage site;

a second movable arm configured to erect each cutout; and a downstream conveyor that takes over and removes box blanks;

the first and second moveable arms are combined on a frame of a bench inserted between the storage site and the downstream conveyor;

the bench comprises:

a ramp inclined upward at an angle between 30° and 60° with respect to a horizontal plane relative to ground, the ramp comprises-two longitudinal members for supporting the cutouts, the two members laterally arranged and spaced apart, each of the two members defining a longitudinal bottom support and a lateral wall for guiding the cutouts between a bottom point (B) and a top point (H) of the ramp; wherein the ramp is divided into two portions, a lower portion that is stationary and an upper portion, at the level of a forming station, that is retractable so as to enable the passage of the blank across the ramp between the lateral walls of the longitudinal members so that the blank can be transferred to the downstream conveyor;

a transverse shaft located at a lower portion of the ramp and configured as a pivot for the first movable arm;

a first repository in which the bottom reference point (B) is located at the lower portion of said ramp, opposite an outlet of the storage site, in order to receive the cutouts brought by the first movable arm;

a second repository in which the top reference point (H) is located at the upper portion of the ramp, at the level of an inlet of the forming station, in order to wedge the cutouts before and during forming;

a conveyor, inclined with the ramp, and which extends over a portion of a length of the ramp in order to move the cutouts from one repository to the other, wherein a distance between the two repositories is greater than a largest cutout format dimension;

a device for forming each cutout, comprising a forming arm comprising suction cups pivotably connected to a second transverse shaft and maneuvered by an actuator, which second transverse shaft coincides, within a cardboard thickness range, with an angle formed by a dihedral of the repository located at the level of the forming station; and a transfer device in the form of an arm with suction cups and pivotably connected to a third transverse shaft, the transfer device configured to assist in forming the cutout before bringing the cutout in the form of a box blank to the downstream conveyor device.

8. The machine according to claim 7, wherein the ramp is inclined upward at an angle of approximately 45°.

* * * * *